US005080453A

United States Patent [19]

Miller

[11] Patent Number: 5,080,453

[45] Date of Patent: Jan. 14, 1992

[54] UTILITY CABINET FOR MOUNTING ON SLOPING WALLS

[76] Inventor: Guy D. Miller, 176 Granada St., Atlantic Beach, N.Y. 11509

[21] Appl. No.: 633,114

[22] Filed: Dec. 24, 1990

[51] Int. Cl.[5] ..... A47B 95/02

[52] U.S. Cl. ..... 312/245; 312/282; 312/373

[58] Field of Search ..... 312/227, 282, 245; 211/87; 108/47, 6

[56] References Cited

U.S. PATENT DOCUMENTS 843,719 2/1907 Umberger ..... 312/282 X
983,734 2/1911 Lowenstein ..... 312/245
3,173,545 3/1965 La Mar ..... 211/87
3,176,942 4/1965 Mitchell et al. ..... 312/227 X

*Primary Examiner*—Joseph Falk

[57] ABSTRACT

Utility cabinet for mounting on sloping walls, for instance on boats, has front and rear members, a top member and a bottom member, which form an enclosure. The plane of the rear member is at an angle to the plane of the front member to accommodate mounting on sloping walls. A plurality of shelves are mounted in said enclosure. The front member is hinged at the bottom member for use as a desk or table. A pair of adjustable chains are connected from the top of the front member to the top member.

3 Claims, 2 Drawing Sheets

UTILITY CABINET FOR MOUNTING ON SLOPING WALLS

This invention relates to utility cabinets, for instance, on boats where the space is scarce and the mounting is difficult.

BACKGROUND

Storage and utility space is at a premium on boats, especially those which have sloping walls due to the shape of the hull. There is a great need for storage space and also for desk and table space with adequate lighting and instrument mounting space.

PRIOR ART

Applicant does not know of any prior art.

THE INVENTION

Utility cabinet for mounting on sloping walls, for instance on boats, has front and rear members, a top member and a bottom member which form an enclosure. The plane of the rear member is at an angle to the vertical to accommodate mounting on sloping walls. A plurality of shelves are mounted in said enclosure. The front member is hinged at the bottom to the bottom member for use as a desk or table. A pair of adjustable chains are connected from the top of the front member to the top member.

OBJECTS OF THE INVENTION

A principal object of the invention is to provide new and improved utility cabinets for mounting on sloping walls, for instance, on boats.

Another object of the invention is to provide new and improved utility cabinets which will provide storage, desk and table surfaces.

Another object of the invention is to provide new and improved utility cabinets for mounting on sloping walls, comprising; front and rear members, top member and bottom member forming an enclosure, the plane of the rear member being at an angle to the vertical to accommodate mounting on sloping walls, a plurality of shelves mounted in said enclosure, the front member being hinged at the bottom to the bottom member, and a pair of adjustable chains connected from the top of the front member to the top member to provide a desk or table surface.

These, and other objects of the invention, will be apparent from the following specification and drawings, of which;

Figure 3:
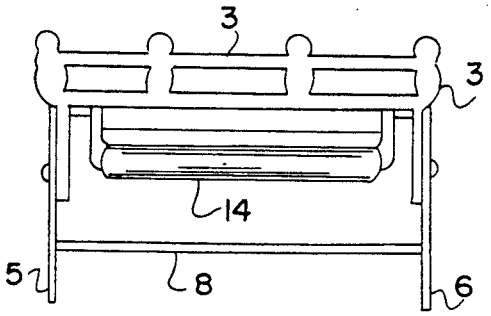
FIGS. 3 and 4 are detailed views of FIG. 1
Figure 2:
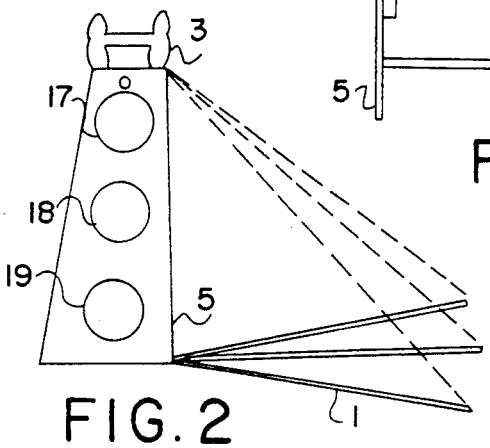
FIG. 2 is a side view of FIG. 1

Referring tot he drawings, the cabinet has a front member 1, a rear member 2, two side members 5 and 6 and a top member 3.

These members from an enclosure in which are mounted several shelves 7, 8, etc. with lip 16.

The front member 1 is hinged at its bottom to the bottom member 4 and is rotatable to provide a desk or table space.

In the open position it is supported by adjustable chains 9 and 10. The cabins are adjustable since they can be wound up on spool 11, and a corresponding spool on the other side.

Figure 4:
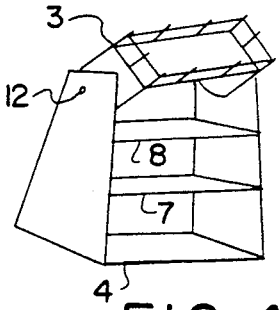
Figure 1:
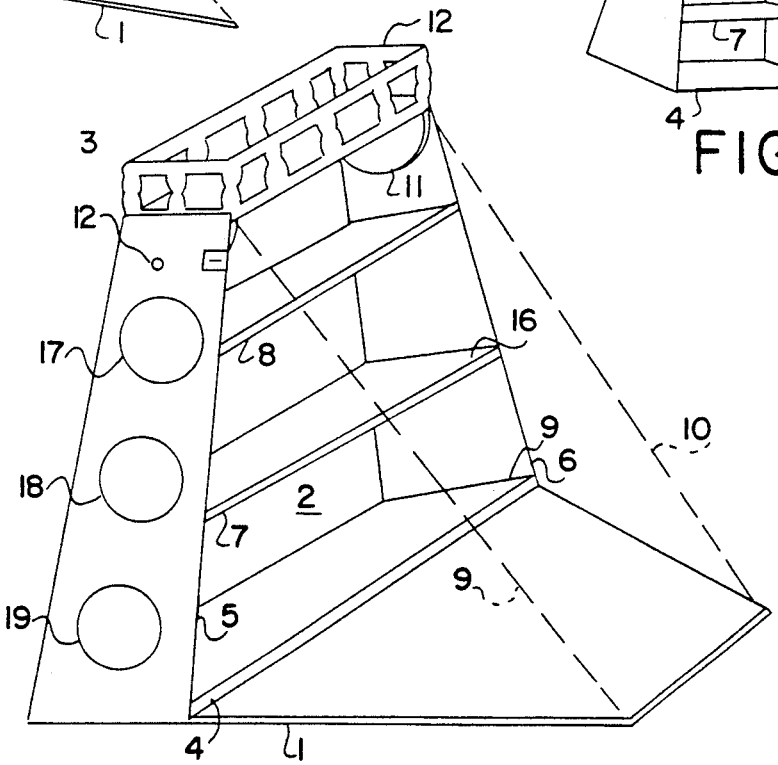
FIG. 1 is a perspective view of an embodiment of the invention.

The top member 3 is formed with a railing 12 so that the top member may be used holding cups, glasses or other articles. The top member 3 is rotatably mounted on the side members by pins 12 as illustrated in FIG. 4, and underneath the member 3 is mounted a fluorescent light 14. The member 3 is rotatable as when it is rotated to the position shown in FIG. 4.

The top of the cabinet will be ventilated, which is useful if there are any articles in the cabinet that require ventilation.

Also, the rotation provides direction of light form the fluorescent tube 14 sot hat it can be directed down towards the desk area and, also, up on the wall and ceiling behind the cabinet.

Figure 5:
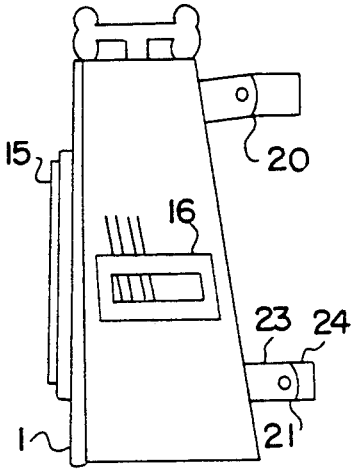
FIG. 5 is a side view, illustration mounting brackets.

FIG. 5 shows a side view of the cabinet with special mounting brackets 20 and 21. These brackets are adjustable in angle and length. Basically, the bracket comprises two pieces 23 and 24, which are nested together. One of the members has a slot and the other member has a pin so that the members can be rotated relative to each other and also can adjust their overall length. This bracket is more fully discussed in my co-pending application for "Universal Mounting Bracket", Ser. No. 07,575,811, filed Aug. 8, 1990.

Figure 7:
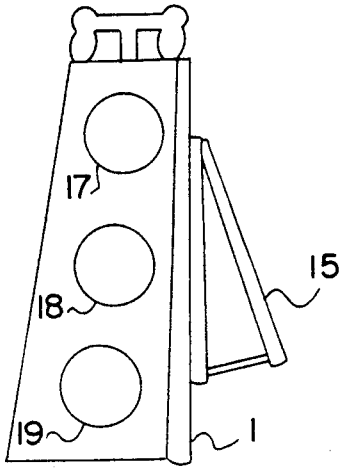
FIG. 7 is a side view of FIG. 6.
Figure 6:
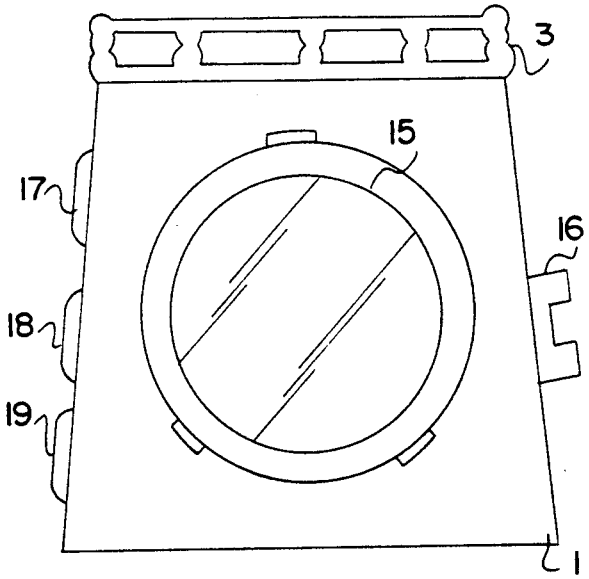
FIG. 6 is a front view of a mirror mounting.

FIG. 6 is a front view of the cabinet, showing the mirror 15, which is pivotally mounted on the front member 1, FIG. 7.

The cabinet may also mount navigational and weather instruments such as thermometer 17, barometer 18 and hygrometer 19.

On the other side of the cabinet is shown a holder 16 for pens, pencils and small tools.

More specifically, this Utility Cabinet is adapted to be mounted on a sloping bulkhead, an area in sailing vessels that has never been fully utilized. It is unique in its design, which can accommodate any angled bulkhead comfortably. It is also multi-functional, while still being compact.

The mounting brackets used are Universal Mounts. They are unique in that they allow for vertical adjustment to any degree of the vessel bulkhead. They rotate 360 degrees and have a horizontal and/or vertical movement of 180 degrees. They are also longitudinally adjustable. The spacing from a wall can also be varied, depending on the need. This can be very advantageous when dealing with protruding instruments on the bulkhead itself.

The cabinet has a top in rail 12. Besides the esthetic novelty of the top in rail unit, its practical functions are as follows:

a) With case in front in rotatable position, air circulation is permitted through top section. This aids in proper operation of weather instruments and adequate ventilation for medical supplies, or any other items that occupy the shelves.

b) The 90 degree rotation of the top allows the fluorescent light to be directed to the most advantageous position. Its lens can also be changed to red for night use. When the cabinet door is in the closed position, the light can be used as a night light.

c) Its ability to rotate accommodates proper angle to bulkhead.

d) Allows for easy placement of eyeglasses, etc.

The cabinet may have a complete weather station; consisting of a Temperature gauge, a Barometer, and a Hygrometer.

The cabinet front door becomes a writing table when in a down position. The chains are adjustable to allow for a comfortable writing position.

A pen, pencil and divider holder 16 may be mounted on the cabinet.

The shelves have a ¼" lip to keep contents of the shelves in place.

A mirror is hinged at the top to accommodate all viewing angles.

A piece of wood, the width of the distance from the bulkhead, placed on the bottom brackets, allows for chart or other storage behind the cabinet.

I claim:

1. Utility cabinet for mounting on sloping walls comprising:

front and rear members, top member and bottom member forming an enclosure, the plane of the rear member being at an angle to the front member to accommodate mounting on sloping walls, a plurality of shelves, mounted in said enclosure, the front member being hinged at the bottom to the bottom member, and a pair of adjustable chains, connected from the top of the front member to the top member, to provide a desk or table surface, wherein the top member is rotatably mounted on the side members.

2. Apparatus as in claim 1, wherein a light is mounted under the top member.

3. Apparatus as in claim 2, having a light is mounted under the top member, and wherein the top member has a rail to accommodate small articles.

* * * * *